United States Patent [19]

Edwards

[11] Patent Number: 4,785,371

[45] Date of Patent: Nov. 15, 1988

[54] ELECTROSTATIC DISSIPATING FOOTWEAR

[75] Inventor: Robert G. Edwards, St. Louis County, Mo.

[73] Assignee: Interco Incorporated, St. Louis, Mo.

[21] Appl. No.: 936,043

[22] Filed: Nov. 28, 1986

[51] Int. Cl.[4] ..... H05F 3/02

[52] U.S. Cl. ..... 361/224

[58] Field of Search ..... 361/223, 224

[56] References Cited

U.S. PATENT DOCUMENTS

| | | | |
|---|---|---|---|
| 2,279,094 | 4/1942 | Siers . | |
| 2,407,189 | 9/1946 | Taber, Jr. et al. | 361/224 |
| 2,586,747 | 2/1952 | Van Atta et al. . | |
| 2,712,098 | 6/1955 | Legge | 361/223 |
| 2,933,651 | 4/1960 | Legge | 361/223 |
| 2,955,234 | 10/1960 | Price | 361/223 |
| 3,007,083 | 10/1961 | MacQuaid, Jr. et al. | 361/224 |
| 3,596,134 | 7/1971 | Burke . | |
| 3,898,538 | 8/1975 | Dalton . | |
| 3,993,932 | 11/1976 | Weigl | 361/224 |
| 4,150,418 | 4/1979 | Berbeco . | |

*Primary Examiner*—L. T. Hix

*Assistant Examiner*—Brian W. Brown

*Attorney, Agent, or Firm*—Donald J. Fitzpatrick; Peter S. Gilster

[57] ABSTRACT

An electrostatically dissipating shoe protects against building up of electrostatic charges by dissipating of such charges through controlled ohmic path leakage between foot and ground. The shoe outsole is formed of synthetic material of substantial resistivity, providing overall resistance across it of about $10^6$–$10^8$ ohms. A flexible dissipating strip of synthetic material treated to be slightly conductive (about $10^5$ ohm-cm) overlies the outsole and extends along a major portion of the shoe length beneath an insole, being secured to the insole by electrically conductive adhesive. At least a heel portion of the insole is apertured over the strip. A cushion layer and/or sock liner overlies the insole, being also of substantial resistivity (e.g., about $10^5$ ohm-cm), and secured by conductive adhesive, which also fills the apertures for providing a conductive path through them to the strip. The construction creates an ohmic path continuous between foot and ground having resistance of $10^6$–$10^8$ ohms. Various alternative shoe constructions utilizing these principles and features are disclosed.

10 Claims, 1 Drawing Sheet

ELECTROSTATIC DISSIPATING FOOTWEAR

BACKGROUND AND SUMMARY OF THE INVENTION

This invention relates to footwear of the type for providing protection against building up of electrostatic charges by dissipation of electrostatic charges through controlled ohmic path leakage between the user's foot and ground.

It has been known for many years to provide footwear which is electrically conductive, exhibiting the capability of conducting electrical charges to ground for various purposes. Thus, such footwear to be worn in certain explosive environments is known as conductive, and may exhibit overall resistance of from zero to about $10^4$ ohms. For example, Siers U.S. Pat. No. 2,279,094 discloses conductive footwear of a type to be worn in operating rooms or where explosives are present. Such footwear includes an insole having a conductive metal stiffening member. So also, Berbeco U.S. Pat. No. 4,150,418 discloses a disposable slipper or shoe cover for use in an operating room, and including a strip of conductive material exteriorly of the shoe for providing good electrical conduct with the floor.

On the opposite extreme, shoes to be worn by those exposed to the possibility of electrical exposure, known as insulating, desirably should provide a resistance between the user's foot and ground of from about $10^{14}$ to about $10^{19}$ ohms.

There is an only slightly more conductive range of interest wherein the footwear, termed antistatic, must exhibit very little leakage. Such footwear should have a resistance in the range of $10^9$–$10^{14}$ ohms, to prevent static charges from building up.

However, there is a much more practical range of interest, namely footwear exhibiting overall resistance between user's foot and ground in the range of about $10^6$ to about $10^8$ ohms. Such footwear, termed static dissipating, should be worn by persons in the electronic and computer industries which must observe precautions to avoid and/or to discharge static electricity which may build up upon the body and clothing, since electronic components, such as integrated circuits and other solid state devices, readily can be damaged by electrical discharges and/or potentials which build up on the body and clothing because of static electrical charges. However, footwear having such resistance will not expose the wearer to undue risk of injury from electrical contact, as would conductive footwear. The present invention relates to static dissipating footwear exhibiting resistance in the latter range. Such footwear may also be termed static control footwear.

Various rather cumbersome and sometimes annoying expedients have been proposed in the electronics industry for causing static electricity to bleed off, i.e., to be discharged, from the body and clothing. For example, there have been proposed body grounding heel straps (as in Van Atta et al U.S. Pat. No. 2,586,747), leg straps (as in Legge U.S. Pat. Nos. 2,712,098 and 2,933,651), wrist straps (as in Burke U.S. Pat. No. 3,596,134) and various external devices (as in Price U.S. Pat. No. 2,955,234 which proposed a conductive foil tape for connecting the inside of a shoe to a conductive rubber element exteriorly of the shoe). Straps and the like require attachment when working in an area where protection is to be afforded, but then must be removed subsequently. These devices are annoying as well as uncomfortable and so their use sometimes may be overlooked deliberately.

Although it has been proposed to provide conductive footwear as evidenced by the above-referenced Siers U.S. Pat. No. 2,279,094, footwear which is merely conductive, such as heretofore used for protection of persons in explosive areas, is not at all suitable for use in the electronics industry because of risk of fatal or other serious injury from electrical shock; and existing footwear designs have not been intended for or capable of providing protection against the building up of electrostatic charges through precisely controlled ohmic path leakage, wherein footwear must have resistance precisely controlled in the above noted range of $10^6$ to $10^8$ ohms.

A fundamental limitation of existing conductive or antistatic footwear designs is that they have not been capable of or well-suited for providing discharge in all modes of usage, from the toe to the heel of the shoe, and irrespective of whether or not the heel is in contact with ground. Alternatively, they may not provide uniform contact of the foot over its entire length within the shoe. The wearer, because of a certain posture or position, such as when seated, may not have the sole and heel both fully in ground contact.

For example, anti-static footwear as disclosed in Dalton U.S. Pat. No. 3,898,538 proposes an electrically resistive panel for connecting the insole to the outsole at only the ball of the foot. Also, for certain body positions, part of the foot may be out of contact with the sock liner. Therefore, a reliable shoe construction intended for providing discharge of electrostatic charges must reliably present a path of discharge over more than just the heel of the shoe, or over more than just the sole or ball of the foot. It must provide its precise range of resistivity interiorly over at least a major portion of the foot and exteriorly over at least a major portion of the length of the shoe from the toe to the heel. Yet, the shoe must be capable of economic manufacture in order to be affordably priced.

Among the several objects of the invention may be noted the provision of improved footwear of electrically conductive type which exhibits resistance in the range useful for providing controlled ohmic path leakage for dissipating electrostatic charges from the body to ground; which provides such dissipation by presenting an ohmic path having resistance in the rang greater than used heretofore for conductive footwear, but less than that used for insulating shoes; which reliably and uniformly exhibits resistance in the range of from about $10^6$ to about $10^8$ ohms; which provides reliable ground contact for all modes of usage and position of the shoe, by presenting interiorly an area of contact between the foot of the user and the insole over substantially full foot length and width, and exteriorly over the full width and length of the shoe from toe to heel; which is mechanically and reliably constructed to provide a permanent method of construction of the shoe in order to bring about footwear of marked reliability for dissipating static charges; and which during manufacture permits the use of easily obtainable materials without bringing about a major change or modification of the manner of manufacture heretofore used for shoes of the various styles to which the invention is applicable; which utilize novel methodology and principles of construction which can be incorporated into a remarkably wide variety of footwear styles.

Briefly, an electrostatically dissipating shoe of the present invention for providing protection against the building up of electrostatic charges by dissipating such charges through controlled ohmic path leakage between the user's foot and ground. The new shoe includes an insole of controlled resistivity. The insole may be either a separate element of the shoe, or may be formed by the upper of the shoe as folded around for that purpose. An elongated narrow member of flexible slightly electrically conductive material, termed a dissipative strip, is secured to the insole between the insole and the outsole by the use of layers of electrically conductive adhesive above and below the dissipative strip. Further, the shoe is provided with an outsole compounded of a material exhibiting a predetermined resistivity. The outsole has an integrally formed heel. A substantial length of the insole is provided with a plurality of apertures, and electrically conductive adhesive utilized for securing the dissipative strip fills such apertures for providing an electrically conductive path of precisely controlled resistance value from the user's foot, through the dissipative strip, and thence to the outsole including its heel portion for conducting electrostatic charges from the user's foot to ground during all modes of usage of the shoe.

Other objects and features will be in part apparent and in part pointed out hereinbelow.

DESCRIPTION OF THE PREFERRED EMBODIMENT

Figure 1:
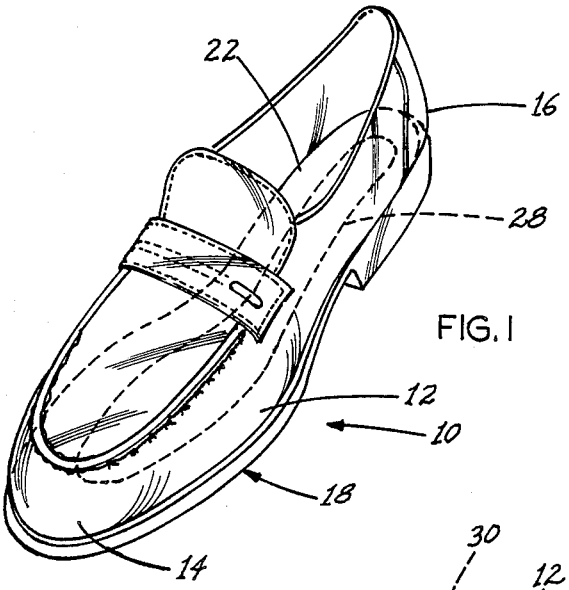
FIG. 1 is a perspective view of an electrostatic dissipating shoe constructed in accordance with and embodying the present invention, such shoe being representative of only one of many possible styles of shoe.

Referring to the drawings, illustrated generally at 10 is an electrostatic dissipating shoe which is but one of many possible styles and variations of footwear to which the present invention is applicable. Shoe 10 includes an upper designated generally at 12.

The upper is formed of leather or other known materials useful for shoe construction to provide a forepart 14 of the shoe and a heel portion 16. Although a moccasin style shoe is shown, the shoe may be any of numerous other types whether or not laced, including casual, loafer, flats, wedges, low or high heeled, steel-toed safety, and so forth. Upper 12 is secured by a known securement or welting technique to an outsole generally designated 18 and including an integrally formed heel portion, here represented by a distinctly formed heel 20. Provided within shoe 10 is a sock liner 22.

Figure 2:
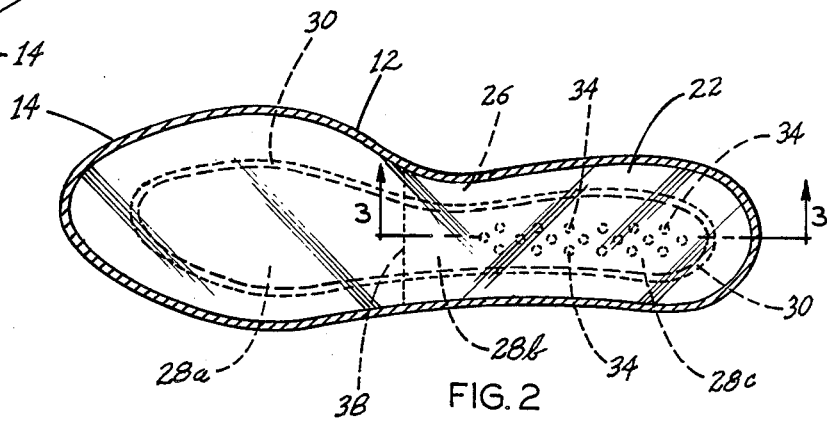
FIG. 2 is a top plan view of an insole utilizing the construction of the shoe of FIG. 1.

Referring to FIG. 2, the upper 12 includes a bottom portion 24 extending at least partly under the foot of the wearer upon which ultimately will be received an insole 26 and a cushion layer 27 and finally said sock liner 22, which lining may be full length or three-fourth length as generally illustrated. The shoe upper may be constructed so that its bottom portion fully closes beneath the upper, as by being stitched lengthwise beneath the forepart, or there may instead be provided only a partial bottom portion with sufficient inwardly directed marginal extent, as illustrated, for ultimate securement to the outsole.

In any event, provided in a rearward extent of the insole are a plurality of apertures 34 placed in a pattern such that numerous ones of said apertures, at least, may overlie a certain dissipating member or so-called dissipating strip 28 which is slightly conductive by virtue of having a certain resistivity as more fully described below. Apertures 34 are further of sufficient dimension so as to receive conductive adhesive which is applied for purposes soon apparent.

As will be seen by its outline in FIG. 2, dissipating strip 28 extends along at least a major portion of the length of the upper from the toe to the heel and thus along a major portion of the length of the wearer's foot, from a point at least slightly proximal to the ball of the foot to the heel of the foot. In plan, dissipating conductive strip 28 is of outsole conformal shape in plan but proportionately smaller than the outsole in order to define a marginal space 30 between the periphery of dissipating strip 28 and the periphery of outsole bottom portion 24. Therefore, dissipating strip 28 includes a substantially widened forward portion **28*a* under the forepart of the foot, a narrow instep portion 28*b*, and a narrow heel portion 28*c* under the heel of the foot, heal portion 28*c* being only slightly wider than the instep portion. Thus, because of marginal space 30 around the entire periphery of strip 28, each of portions 28, 28*b* and 28*c* is narrower than corresponding portions of insole 26**.

Outsole 18 is preferably molded from polyurethane, as formed by two-part mix incorporating electrically conductive material such as carbon particles to provide homogeneous distribution of the particles in the mixed material for providing a volume resistivity which is substantial, so as to give an overall resistance through the outsole of about $10^6$ to about $10^8$ ohms. Heel 20, being integrally formed, also is of the same resistivity. Throughout the present description, all resistivity values refer to conventional volume resistivity measurements defining current flow per unit area through a volume of material.

Figure 3:
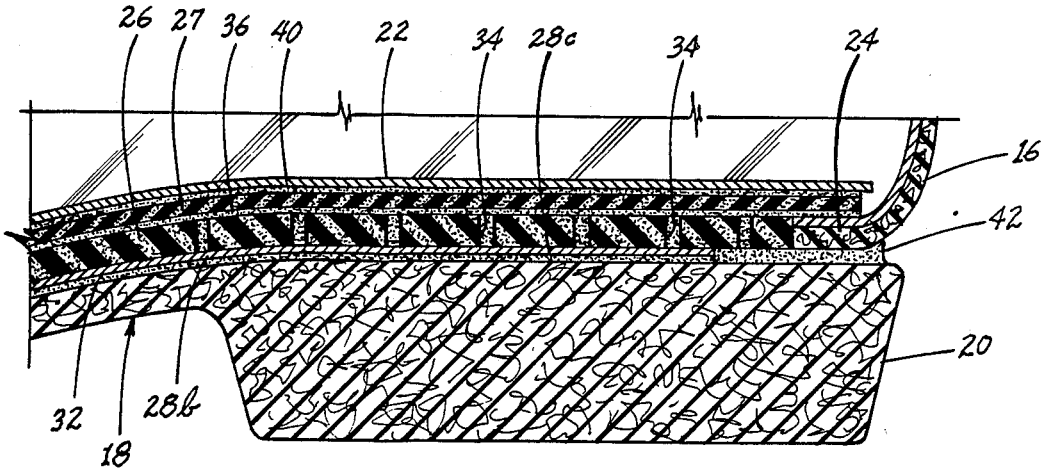
FIG. 3 is a partial longitudinal cross section, wtih thicknesses being slightly exaggerated, and as taken generally along line 3—3 of FIG. 2.

In manufacturing the shoe, the upper surface of outsole 18 is coated centrally in the region to be overlaid with the dissipating strip with layer of conductive adhesive of known type, and which includes carbon or other conductive particles therein for providing a low resistivity, possibly not greater than about $10^4$ ohm-cm. A layer of such cement, or adhesive, is designated 32 in FIG. 3.

Dissipating strip 28 is most preferably of open cell synthetic foam material such as polurethane treated to provide a substantial resistivity, preferably about but not greater than about $10^5$ ohm-cm, as for example by dipping the strip material in a suitable conductive solution of commercially avaialable type in order to impart to the intrinsically less conductive material the desired resistivity. Insole 26, shaped complementarily, is preferably but not necessarily of multilayer material, while illustrated in FIG. 3 for the sake of clarity and simplicity as if a single layer. If multilayered, insole 26 includes a thin upper layer of PVC provided with a nylon backing to which dissipating strip 28 is adhesively secured, as below described. In this way, the insole is rendered moderately conductive along its entire length. This will conduce to establishment of a conductive path for static discharge no matter what part of the wearer's foot bears on the insole. Further, insole 26 is provided in its rearward extent with a series of apertures 34 which open fully through it and the dissipating strip heel portion 28c. It is preferred that apertures 34 be staggered as shown and spaced along the width and length of strip portion 28c (FIG. 2) but need not extend beyond the side boundaries of strip 28.

It is required that the PVC material of the insole exhibit a substantial resistivity, preferably so as to give an overall resistance through it of about $10^6$ ohms. Cushion layer 27, which may be of open-cell foam material sold under the mark "ENSULITE" has a substantial resistivity, preferably about $10^5$ ohm-cm. A layer 36 of the same conductive adhesive secures cushion layer 27 to insole 26.

During assembly, the rear portion of insole 26 is dipped in conductive solution, the same being of liquid form, to a location generally identified by a line 38 (FIG. 2). Conductive adhesive coats both sides to fill apertures 34. This step provides a conductive path through the adhesive from the upper side of insole 26 to dissipating strip portion 28c.

Sock lining 22 is secured to cushion layer 27 by a further layer 40 of the conductive adhesive. The sock lining material is is of substantial resistivity, so as to give an overall resistance through the sock lining of about $10^6$–$10^8$ ohms.

According to the preferred method of assembly, dissipating strip 28 is affixed to the insole after such treatment; such assembly is then in turn secured to outsole 18 by the conductive adhesive, leaving a substantial peripheral margin of the outsole free for securement of the upper. For that purpose, a layer 42 of urethane adhesive is applied to such margin. Then, by combination of applied heat and pressure, the lasted upper is bonded to the outsole by thermal setting of adhesive layer 42. Cushion layer 27 and sock liner 22 are affixed to provide the completed shoe. The upper can be secured by other known methods, such as by Goodyear welt technique.

Insole 26 may alternatively be formed as an integral portion of the upper, as in the case of a so-called tubular shoe upper, there being an opening formed in the rear portion of the bottom surface of the upper, which is stitched longitudinally from the toe to the instep. A so-called heel pin, i.e., a layer of insole-type material but extending only from the heel to the instep, may then be inserted into the upper. The heel pin is apertured, as in the case of the above-described insole, and is dipped in conductive adhesive as hereinabove described before being inserted into the upper. When so inserted, the heel pin has portions exposed through the heel opening of the upper. Dissipating strip 28 is then secured by conductive adhesive, as described above, in order to establish electrical contact with the adhesive-filled apertures of the heel pin. The strip extends substantially from heel to toe as hereinabove described. A full sock lining of the above-stated resistivity is then added.

As a further alternative, a fully tubular upper may be formed, closed at the heel or rear portion, but which portion is similarly apertured. Thus, the upper serves to provide also the full length of the insole, rather than only a portion of it as in the case of the above-described version with tubular upper. The apertures are filled with conductive adheseive, and the dissipating strip is laid over the filled apertures (with the insole inverted for this procedure). The assembly is then bonded to the outsole by use of the previously described procedure.

The same techniques may be used for providing a casual shoe having a full length cushion insole to which the upper is secured. The heel portion is apertured as described above, and the apertures filled with conductive adhesive. The dissipating strip 28 is then secured to the bottom surface of the the cushion insole. Construction is completed by bonding the insole to the outsole according to the previously described procedure.

Conductivity between the foot and insole is thereby provided in all of the various shoe constructions over substantially the entire length of the foot, and such conductive path then continuing via conductive adhesive within the multiple apertures to the dissipating strip, which establishes conductivity over substantially the major portion of the outsole length. One is assured that when any portion of the foot is in contact with the sock lining, cushion layer, or insole, under conditions in which any portion of the outsole (or its heel if a separate element) contacts the floor surface, there will be maintained of an ohmic discharge path for conducting to ground any electrical charges which otherwise could build up on the clothing and/or body of the wearer yet such path being at all times sufficiently resistive that it will not expose the wearer to undue electrical shock risk while wearing footwear of the invention.

Accordingly it is seen that the invention provides an electrostatically dissipating shoe for providing protection against the building up of electrostatic charges by dissipating such charges through controlled ohmic path leakage between the user's foot and ground. Such footwear includes an insole of controlled substantial resistivity. The insole may be either a separate element of the shoe, or may be formed by the upper of the shoe as folded around for that purpose. An elongated narrow member of flexible slightly electrically conductive material is laid upon and secured to the insole between the insole and the outsole by the use of layers of electrically conductive adhesive above and below such strip. Further, the shoe is provided with an outsole formed of a material exhibiting a substantial predetermined resistivity. The outsole has an integrally formed heel. A substantial length of the insole is provided with a plurality of apertures, and electrically conductive adhesive utilized for securing the elongated member fills such apertures for providing an electrically conductive path of precisely controlled resistance value from the user's foot, through the strip, and thence to the outsole including its heel portion for conducting electrostatic charges from the user's foot to ground during all modes of usage of the shoe, whereby a continuous ohmic path having resistance precisely controlled within the range of from $10^6$ to $10^8$ ohms is provided between the sock lining and ground for conducting electrostatic charges from the foot of the user to ground during all modes of usage of the shoe.

In view of the foregoing, it is seen that the several objects of the invention and other advantages are obtained.

Although the foregoing includes a description of the best mode contemplated for carrying out the invention, various modifications are contemplated.

As various such modifications could be made in the constructions and methods herein described and illustrated without departing from the scope of the invention, it is intended that all matter contained in the foregoing description of shown in the drawings shall be interpreted as illustrative rather than limiting.

What is claimed is:

1. An electrostatically dissipating shoe for protection against building up of electrostatic charges by dissipation of electrostatic charges through controlled ohmic path leakage between the wearer's foot and ground, without exposing the wearer to undue risk of injury from electrical contact, said shoe comprising an upper, an outsole including a forepart and a heel normally in ground contact, at least the outsole forepart and heel being formed of a material exhibiting a substantially predetermined electrical resistivity, a dissipating strip, the entirety of which is slightly electrically conductive material, overlying the outsole, the dissipating strip extending substantially along at least a major portion of the length of the shoe continuously from under the forepart of the foot to under the heel of the foot between the toe and heel portion of the shoe to provide portions of the strip underlying both the ball and heel of the foot, the strip being of outsole conformal shape in plan but being proportionately smaller than the outsole, to define a marginal space completely around the periphery of the dissipating strip between the strip periphery and the periphery of the outsole, means for securing the strip to the outsole in electrically conductive relationship, and an insole overlying the strip, the insole providing at least a heel portion layer of material exhibiting a substantial predetermined electrical resistivity and forming a plurality of apertures therein, and at least one further material layer overlying the insole between the foot and insole, the further material layer exhibiting a substantial predetermined electrical resistivity, and means for securing the further material layer to the insole in electrically conductive relationship, and electrically conductive adhesive for filling the heel portion apertures for providing an electrically conductive path between the further material layer and the strip, whereby a continuous ohmic path having precisely controlled resistance within the range of from $10^6$ to $10^8$ ohms is provided between the foot and ground for conducting electrostatic charges from the foot to ground during all modes of usage of the shoe, said continuous ohmic path being thereby sufficiently resistive that it will not expose the wearer to undue electrical shock risk during wearing of the shoe.

2. An electrostatically dissipating shoe for protection against building up of electrostatic charges by dissipation of electrostatic charges through controlled ohmic path leakage between the wearer's foot and ground without exposing the wearer to u ndue risk of injury from electrical contact, said shoe comprising an upper, an outsole including a fore part and a heel normally in ground contact, at least the outsole forepart and heel being formed of a material exhibiting a substantial predetermined electrical resistivity, a dissipating strip, the entirety of which is of slightly electrical conductive material, overlying the outsole, the dissipating strip extending substantially along at least a major portion of the length of the shoe continuously from under the forepart of the foot to under the heel of the foot between the toe and heel portions of the shoe, to provide portions of the strip underlying both the ball and heel of the foot, the strip being of outsole conformal shape in plan but being proportionately smaller than the outsole to define a marginal space completely around the periphery of the dissipating strip between the strip periphery and the periphery of the outsole, the strip having a forward portion under the forepart of the foot, an instep portion, and a heel portion under the heel of the foot, each of said strip portions being narrower than corresponding portions of the insole, a layer of electrically conductive adhesive securing the strip to the outsole in electrically conductive relationship, and an insole overlying the strip, the insole providing at least a heel portion layer of material exhibiting a substantially predetermined electrical resistivity and forming a plurality of apertures therein, and at least one further material layer overlying the insole between the foot and insole, the further material layer exhibiting a substantial predetermined electrical resistivity, a further layer of electrically conductive adhesive securing the further material layer to the insole, the further layer of adhesive also filling the heel portion apertures for providing an electrically conductive path between the further material layer and the strip, whereby a continuous ohmic path having precisely controlled resistance within the range of from $10^6$ to $10^8$ ohms is provided between the foot and ground for conducting electrostatic charges from the foot to ground during all modes of usage of the shoe, said continuous ohmic path being thereby sufficiently resistive that it will not expose the wearer to undue electrical shock risk during wearing of the shoe.

3. An electrostatically dissipating shoe according to claim 2 wherein the further material layer comprises a cushion layer.

4. An electrostatically dissipating shoe according to claim 3, further comprising a sock lining overlying at least a portion of the cushion layer, the sock lining being of material exhibiting a substantial predetermined electrical resistivity, and a third layer of electrically conductive adhesive for securing the sock lining to the cushion layer in electrically conductive relationship.

5. An electrostatically dissipating shoe acoording to claim 4 where the outsole and the insole each exhibits an overall resistance through it of about $10^6$–$10^8$ ohms.

6. An electrostatically dissipating shoe according to claim 2 wherein the further material layer comprises a sock lining, the sock lining having an overall resistance through it of about $10^6$–$10^8$ ohms.

7. An electrostatically dissipating shoe according to claim 2 wherein the the dissipating strip has a resistivity of about but not greater than about $10^5$ ohm-cm.

8. An electrostatically dissipating shoe according to claim 6 wherein the dissipating strip is of open cell synthetic material treated prior to incorporation into the shoe with a conductive solution.

9. An electrostatically dissipating shoe according to claim 8 wherein marginal portions of the upper are secured to the outsole by adhesive within said marginal space.

10. An electrostatically dissipating shoe for protection against building up of electrostatic charges by dissipation of electrostatic charges through controlled ohmic path leakage between the wearer's foot and ground without exposing the wearer to undue risk of injury from electrical contact, said shoe comprising an upper, an outsole including a forepart and a heel normally in ground contact, at least the outsole forepart and heel being formed of material exhibiting a substantial predetermined electrical conductivity, a dissipating strip, the entirety of which is of slightly electrically conductive material, overlying the outsole, the dissipating strip extending substantially along at least a major portion of the length of the shoe continuously from under the forepart of the foot to under the heel of the foot between the toe and heel portions of the shoe, to provide portion of the strip underlying both the ball and heel of the foot, the strip being of outsole conformal shape in plan but proportionately smaller than the outsole to define a marginal space completely around the periphery of the dissipating strip between the strip periphery and the periphery of the outsole, the strip having a forward portion under the forepart of the foot, an instep portion, and a heel portion under the heel of the foot, each of said strip portions being narrower than corresponding portions of the insole, a layer of electrically conductive adhesive securing the strip to the outsole in electrically conductive relationship, and an insole overlying the strip, the insole providing at least a heel portion layer of material exhibiting a substantial electrical resistivity of predetermined value, the heel portion layer forming a plurality of apertures therein, a cushion layer overlying the insole and formed of material exhibiting a predetermined electrical resistivity of substantial value, a second layer of electrically conductive adhesive for adhesively securing the cushion layer to the insole, such second layer of adhesive also filling the heel portion apertures for providing an electrically conductive path between the cushion layer and the strip, a sock lining of material exhibiting a predetermined electrical resistivity of substantial value, and a third layer of electrically conductive adhesive for adhesively securing the sock lining to the cushion layer in electrically conductive relationship, whereby a continuous ohmic path having resistance within the range of from $10^6$ to $10^8$ ohms is provided between the foot and ground for conducting electrostatic charges from the foot to ground during all modes of usage of the shoe, said continuous ohmic path being thereby sufficiently resistive that it will not expose the wearer to undue electrical shock risk during wearing of the shoe.

* * * * *